US007198527B2

(12) United States Patent
Shirayanagi

(10) Patent No.: US 7,198,527 B2
(45) Date of Patent: Apr. 3, 2007

(54) ENGINE CONTROL APPARATUS

(75) Inventor: Naotoshi Shirayanagi, Shizuoka (JP)

(73) Assignee: Asahi Denso Co., Ltd., Shizuoka (JP)

( * ) Notice: Subject to any disclaimer, the term of this patent is extended or adjusted under 35 U.S.C. 154(b) by 0 days.

(21) Appl. No.: 10/811,862

(22) Filed: Mar. 30, 2004

(65) Prior Publication Data

US 2004/0229526 A1 Nov. 18, 2004

(30) Foreign Application Priority Data

Apr. 2, 2003 (JP) ..... P.2003-098846

(51) Int. Cl.
*B63H 21/22* (2006.01)

(52) U.S. Cl. ..... 440/1; 340/5.62

(58) Field of Classification Search ..... 440/84–87, 440/1, 2; 307/326; 340/5.61, 5.21, 5.62, 340/5.72, 10.52, 10.51, 5.25, 426.11; 701/110, 701/115

See application file for complete search history.

(56) References Cited

U.S. PATENT DOCUMENTS 5,171,171 A 12/1992 Tani
5,433,096 A * 7/1995 Janssen et al. ..... 70/278.3
5,632,168 A * 5/1997 Yano ..... 70/278.3
5,803,043 A * 9/1998 Bayron et al. ..... 123/335
5,819,564 A * 10/1998 Watanuki ..... 70/278.2
6,352,045 B1 3/2002 Takashima
6,772,061 B1 * 8/2004 Berthiaume et al. ..... 701/110
7,014,517 B2 3/2006 Suzuki
7,026,912 B2 4/2006 Suzuki
2004/0135670 A1 * 7/2004 Guba ..... 340/5.21
2004/0232772 A1 * 11/2004 Suzuki ..... 307/10.1

FOREIGN PATENT DOCUMENTS

JP 2001-88789 A 4/2001
JP 2001-146148 A 5/2001

* cited by examiner

*Primary Examiner*—Ed Swinehart
(74) *Attorney, Agent, or Firm*—Sughrue Mion, PLLC

(57) ABSTRACT

The engine control apparatus includes: the stop switch body 6; the stop switch knob 3 that allows the engine to stop or to be in an idling state; the lock plate 5; the transponder 9 that can transmit a predetermined ID code; and the control section 11 that receives the ID code transmitted from the transponder 9 and that controls the engine operation based on the ID code; wherein the engine control apparatus is constituted such that, when the lock plate 5 is disengaged from the stop switch knob 3, the stop switch body 6 is activated to allow the engine to stop or to be in an idling state; and the attachment 10 incorporating the transponder 9 is provided separately from the lock plate 5 and is detachably attached to the lock plate 5.

14 Claims, 11 Drawing Sheets

ENGINE CONTROL APPARATUS

BACKGROUND OF THE INVENTION

The present invention relates to an engine control apparatus constituted such that, when a lock plate is disengaged from a stop switch knob, the stop switch is turned on to allow an engine of a small motorboat or the like to stop or to be in an idling state.

A small motorboat is made to glide over water while taking a sharp turn or jumping so that an operator can enjoy a ride. This frequently causes the operator to fall into water. Due to this reason, it is required to, when the operator falls into water, stop the engine to prevent only the small motorboat from further progressing. Thus, a small motorboat is generally provided with a stop switch for allowing, when the operator falls into water, the engine to stop or to be in an idling state.

Specifically, a handle bar of the small motorboat is fixed with a switch case. The switch case has a stop switch knob for activating a stop switch of an insertable resin-made lock plate that has at the base end a tightened wire. The tip end of the wire is fixed to the wrist or the like of the operator so that, when the operator falls into water, the lock plate is disengaged from the stop switch knob to turn on the stop switch, thereby allowing the engine of the small motorboat to stop or to be in an idling state.

As described above, the lock plate is inserted to the stop switch knob to allow the engine to start. This causes a situation where, when another lock plate of a small motorboat or a plate member having a similar shape is inserted, a third party can start the engine without the owner's permission. In order to prevent such a situation where a boat is stolen, a conventional technique (as disclosed in Patent reference 1, for example) has suggested that a small motorboat having a control section in which a transponder incorporating an ID code is embedded in a lock plate and inside the switch case an antenna that can receive the ID code so that the engine is controlled based on the received information.

The above conventional engine control apparatus is constituted such that the ID code of the transponder is transmitted via radio transmission to the antenna and the received information is transmitted to the control section so that the engine is started only when a previously registered regular ID code and the received ID code coincide. When the former is different from the latter, the engine is not started. This can start the small motorboat only when the regular lock plate is inserted to the stop switch knob and thus can prevent the boat from being stolen.

[Patent Reference 1]

Japanese Published Unexamined Patent Application No. 2001-88789

However, in the above conventional engine control apparatus, vibration of the engine mounted in the small motorboat always occurs when the engine is driven. This has created a risk in which the vibration is transmitted to the lock plate to cause a defect in the inner transponder. Specifically, the transponder embedded in the lock plate causes the vibration transmitted to the lock plate to be directly transmitted to the transponder.

SUMMARY OF THE INVENTION

The present invention is made in view of the above. It is an object of the present invention to provide an engine control apparatus in which the vibration of the engine is difficult to be transmitted to the transponder so that the transponder is prevented from having a defect and the service life can be improved.

According to the invention of Aspect 1, an engine control apparatus, including: a stop switch body for allowing an engine to stop or to be in an idling state; a stop switch knob that abuts with the stop switch body to activate the stop switch body to allow the engine to stop or to be in an idling state; a lock plate insertable to the stop switch knob; a transponder that is provided at the lock plate side and that can transmit a predetermined ID code; and a control section that can receive the ID code transmitted from the transponder and that controls the engine operation based on the ID code; wherein the engine control apparatus is characterized in that: when the lock plate is disengaged from the stop switch knob, the stop switch body is activated to allow the engine to stop or to be in an idling state; and the transponder is provided separately from the lock plate and is attached to the lock plate or the vicinity thereof.

According to the invention of Aspect 2, in an engine control apparatus according to Aspect 1, the control section changes the engine performance based on the ID code from the transponder and the transponder is detachably attached to the lock plate or the vicinity thereof.

DETAILED DESCRIPTION OF THE PREFERRED EMBODIMENTS

Hereinafter, embodiments of the present invention will be specifically described with reference to the drawings.

Figure 1:
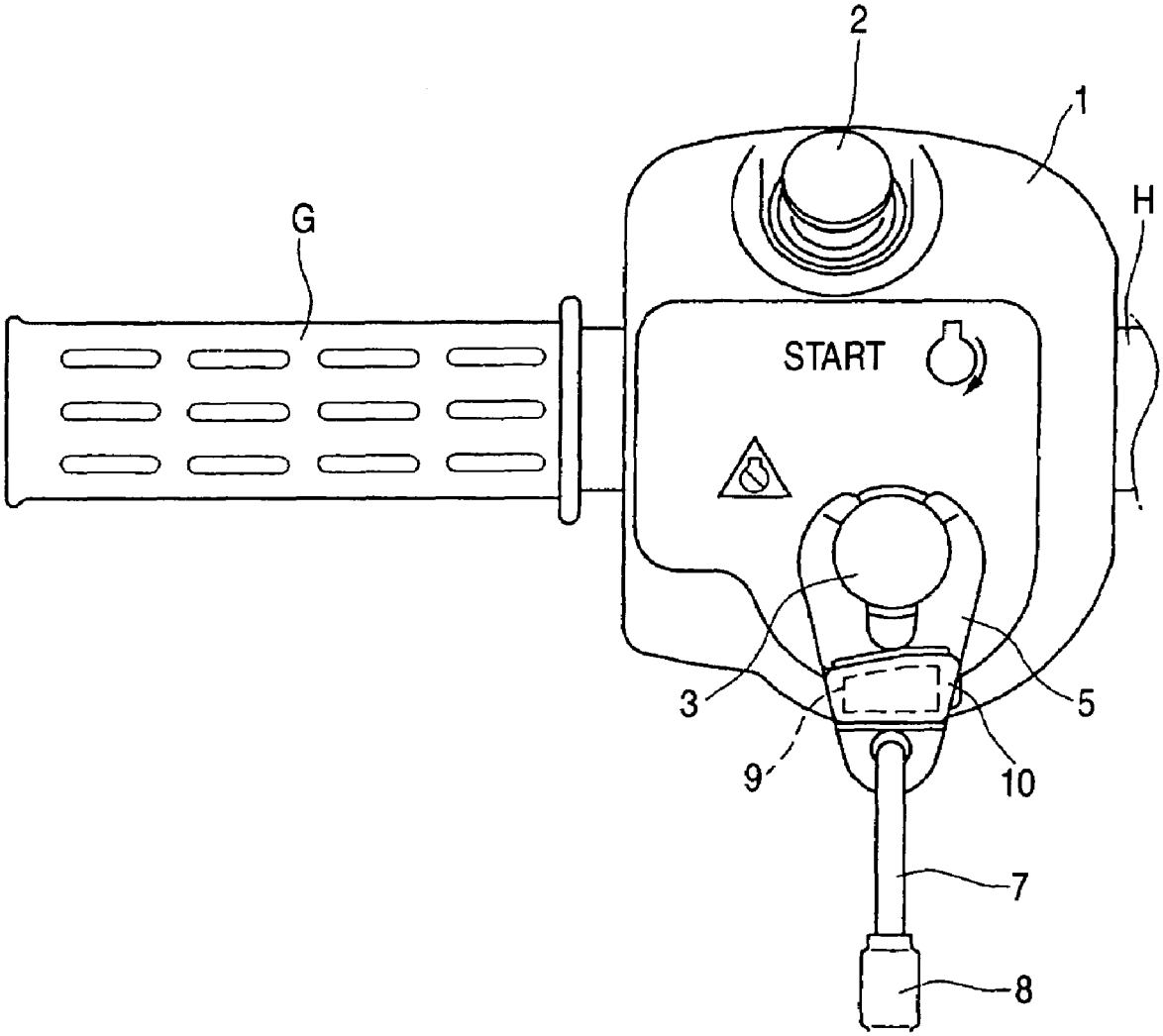
FIG. 1 is a top view illustrating the engine control apparatus for the small motorboat according to embodiment 1 of the present invention.
Figure 2:
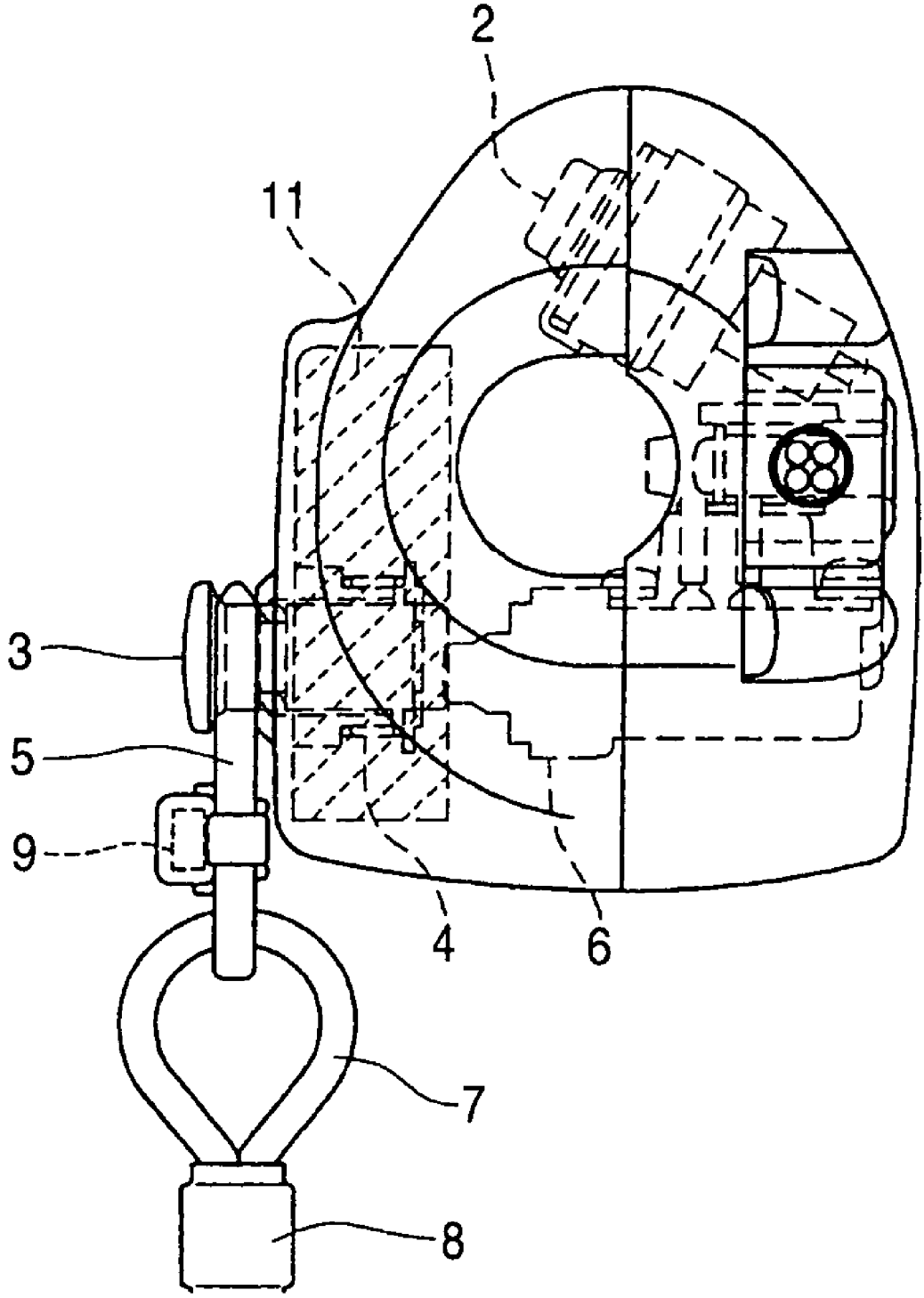
FIG. 2 is a right side view of FIG. 1.

As shown in FIGS. 1 and 2, the engine control apparatus for the small motorboat according to embodiment 1 is provided in the resin-made switch case 1 fixed to the handle bar H of the small motorboat. The switch case 1 provides the start switch knob 2, the stop switch knob 3, the stop switch body 6, and the control section 11. The reference numeral G in FIG. 1 denotes a grip that is grasped by an operator when the operator drives the boat.

The start switch knob 2 is used to start the engine of the small motorboat. The knob is constituted such that, when the knob is pushed, then predetermined electrical conduction may be obtained to start the engine. The start switch knob 2 can be provided to the switch case 1 with an arbitrary position and inclination angle.

As shown in FIG. 2, the stop switch knob 3 is always biased by the spring 4 toward the direction adjacent to the surface of the switch case 1 (right direction in the same drawing). When the lock plate 5 (which will be described later) is inserted between the surface of the switch case 1 and the projection of the stop switch knob 3 (as shown in the same drawing), then the base end of the stop switch knob 3 (right tip end in the same drawing) is separated from the stop switch body 6.

The stop switch body 6 is provided in the switch case 1 and is activated when abutting with the base end of the stop switch knob 3 to allow the engine of the small motorboat to stop or to be in an idling state. This allows, when the lock plate 5 is disengaged from the stop switch knob 3, the stop switch body 6 to activate to allow the engine of the small motorboat to be forcedly stopped or to be in an idling state.

Figure 3:
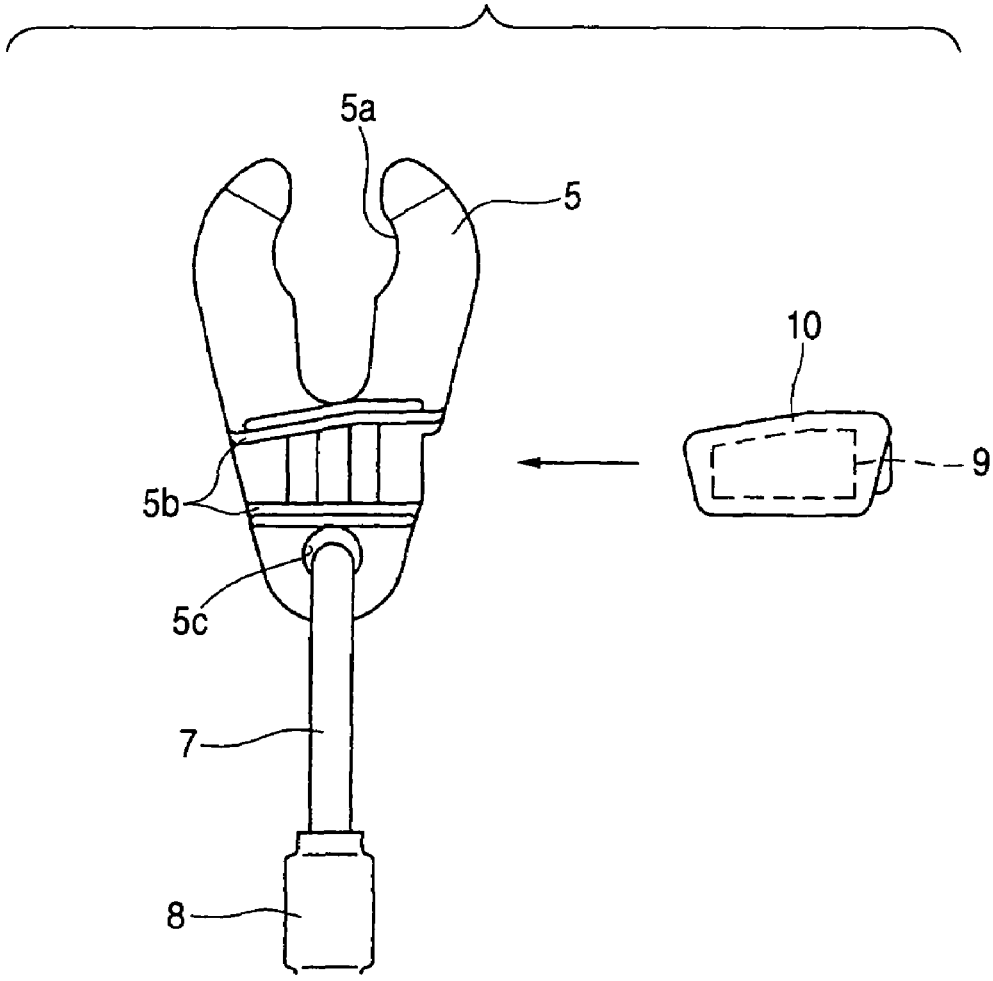
FIG. 3 is a top view illustrating the lock plate and the attachment in the engine control apparatus for the small motorboat according to embodiment 1 of the present invention.

The lock plate 5 includes a resin-made plate-like member and forms, as shown in FIG. 3, the notch 5*a* at one end in the plan view. The lock plate 5 also has at the substantial center two convex sections 5*b* and has at the other end of the plan view a hole 5*c* to which the wire 7 is inserted. The tip end of the wire 7 (not shown) is designed to be attached to the wrist or the like of an operator of the small motorboat.

When the notch 5*a* is engaged with or separated from the periphery side of the stop switch knob 3, the lock plate 5 can be inserted to the stop switch knob 3. This allows, when the operator falls into water, the lock plate 5 to be disengaged from the stop switch knob 3 via the wire 7. In the drawing, the reference numeral 8 denotes a circular ring-shaped metal fitting for inserting the tip end of the wire 7 to the hole 5*c*.

Figure 4:
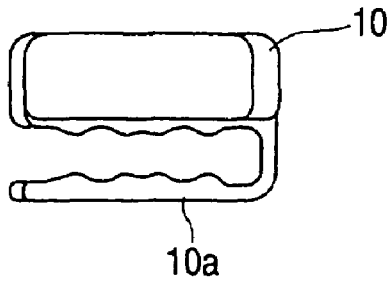
FIG. 4 is a front view illustrating the attachment in the engine control apparatus for the small motorboat according to embodiment 1 of the present invention.

The two convex sections 5*b* formed at the lock plate 5 have a groove-like shape over the surface of the lock plate 5 to which the resin-made attachment 10 incorporating the transponder 9 can be attached. Specifically, this attachment 10 has at the lower face the clip section 10*a* as shown in FIG. 4. The attachment 10 is constituted such that, when the clip section 10*a* sandwiches the top and back face of the lock plate 5 (more specifically, the space between the two convex sections 5*b*), the attachment 10 can be attached.

The transponder 9 is provided at the lock plate 5 side to hold a predetermined ID code and can transmit the ID code from an antenna (not shown) via radio transmission. The ID code includes information for providing an arbitrary engine performance. The engine performance includes, for example, the engine performance for a beginner or one for an experienced user. In this embodiment, the engine is first allowed to be in an idling state when the lock plate 5 is engaged with the stop switch knob 3 to subsequently activate the start switch knob 2.

Specifically, the transponder 9 is incorporated in the attachment 10 but is separately provided from the lock plate 5. As a result, even when the engine vibration is transmitted to the lock plate 5, the vibration can be absorbed between the lock plate 5 and the attachment 10 to a certain level and thus can be difficult to be transmitted to the transponder 9. This can prevent the transponder 9 from having a defect due to the vibration and the service life can be improved.

The control section 11 is provided in the vicinity of the stop switch body 6 in the switch case 1 and can receive an ID code transmitted from the transponder 9 and control, based on the ID code, the engine operation of the small motorboat.

Namely, a plurality of transponders 9 having various ID codes are prepared so that the operator can select an arbitrary one to attach the selected one to the lock plate 5 thereby providing engine performance in accordance with the operator's preference.

In this way, this embodiment allows the control section 11 to change the engine performance based on the ID code from the transponder 9 and allows the transponder 9 to be detachably attached to the lock plate 5. This allows the operator to easily exchange the transponder 9 according to the need. Specifically, the engine performance can be changed in accordance with the operator's preference in an easy manner.

Figure 5:
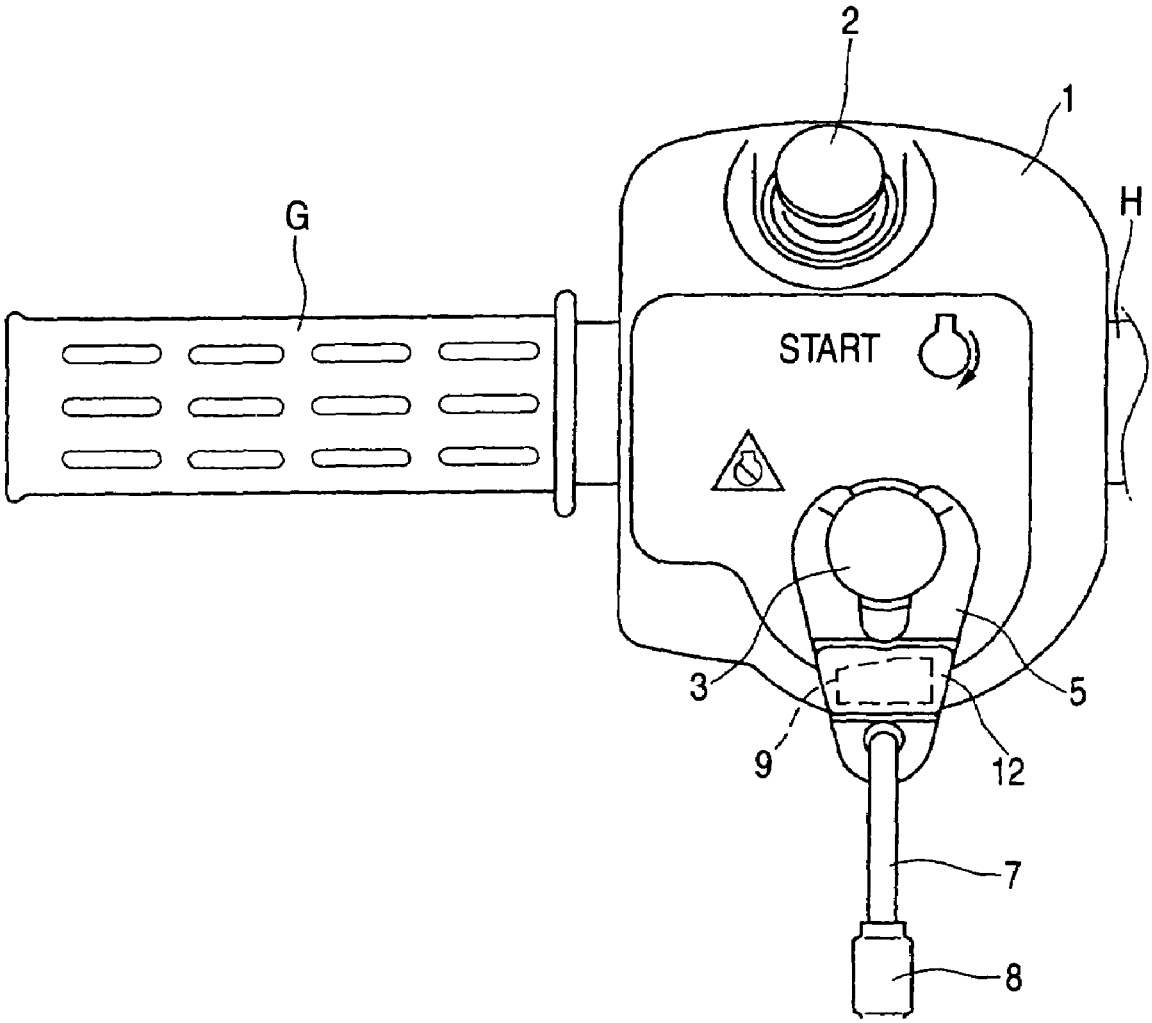
FIG. 5 is a top view illustrating the engine control apparatus for the small motorboat according to embodiment 2 of the present invention.
Figure 6:
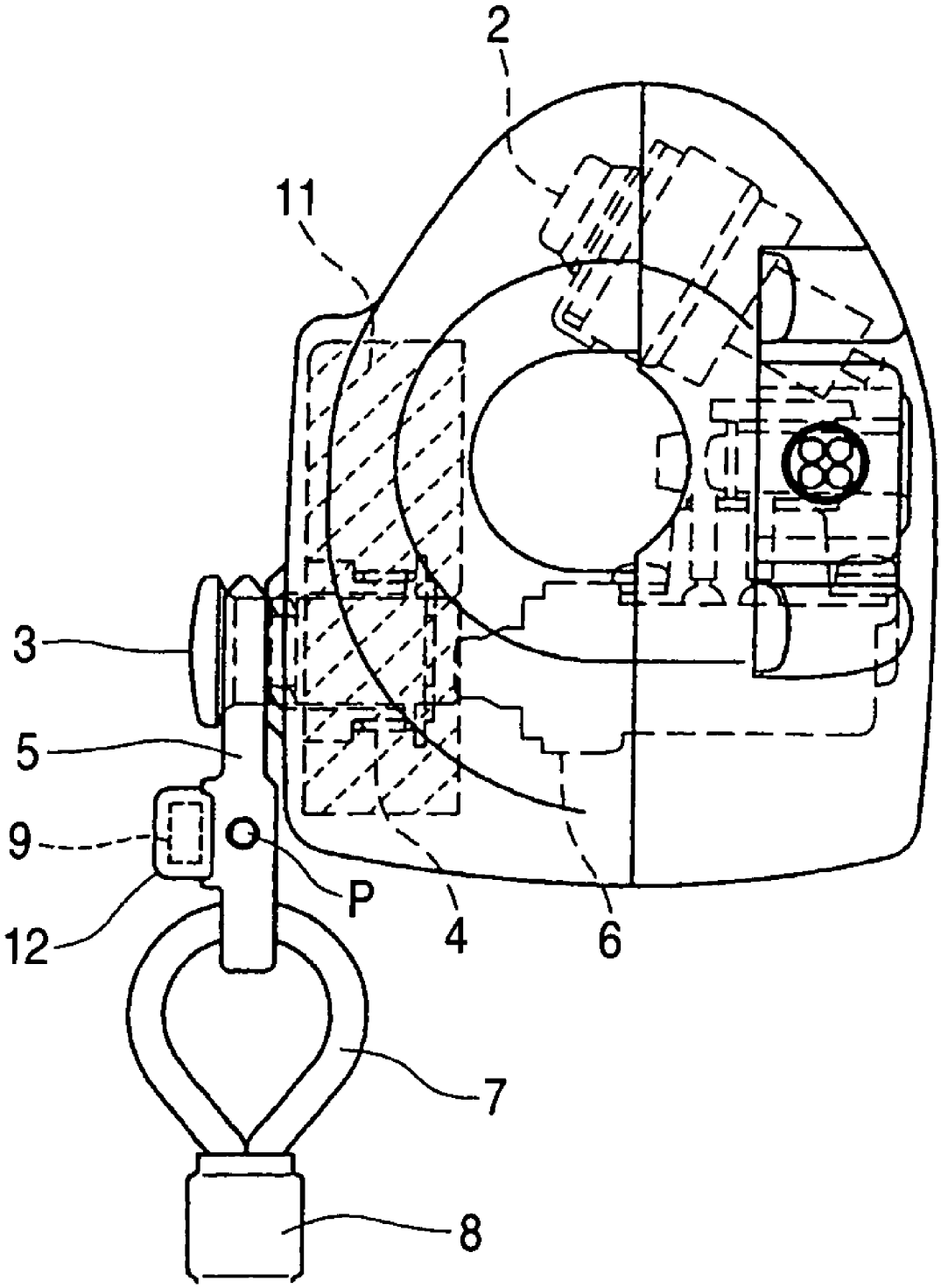
FIG. 6 is a right side view of FIG. 5.

Next, the engine control apparatus for the small motorboat according to embodiment 2 will be described. As shown in FIGS. 5 and 6, the engine control apparatus for the small motorboat according to this embodiment is formed in the resin-made switch case 1 fixed to the handle bar H of the small motorboat. The switch case 1 is provided with the start switch knob 2; the stop switch knob 3; the stop switch body 6; and the control section 11. Additionally, the same symbols are given according to the same components as those of embodiment 1, so a detailed description is omitted.

Figure 7:
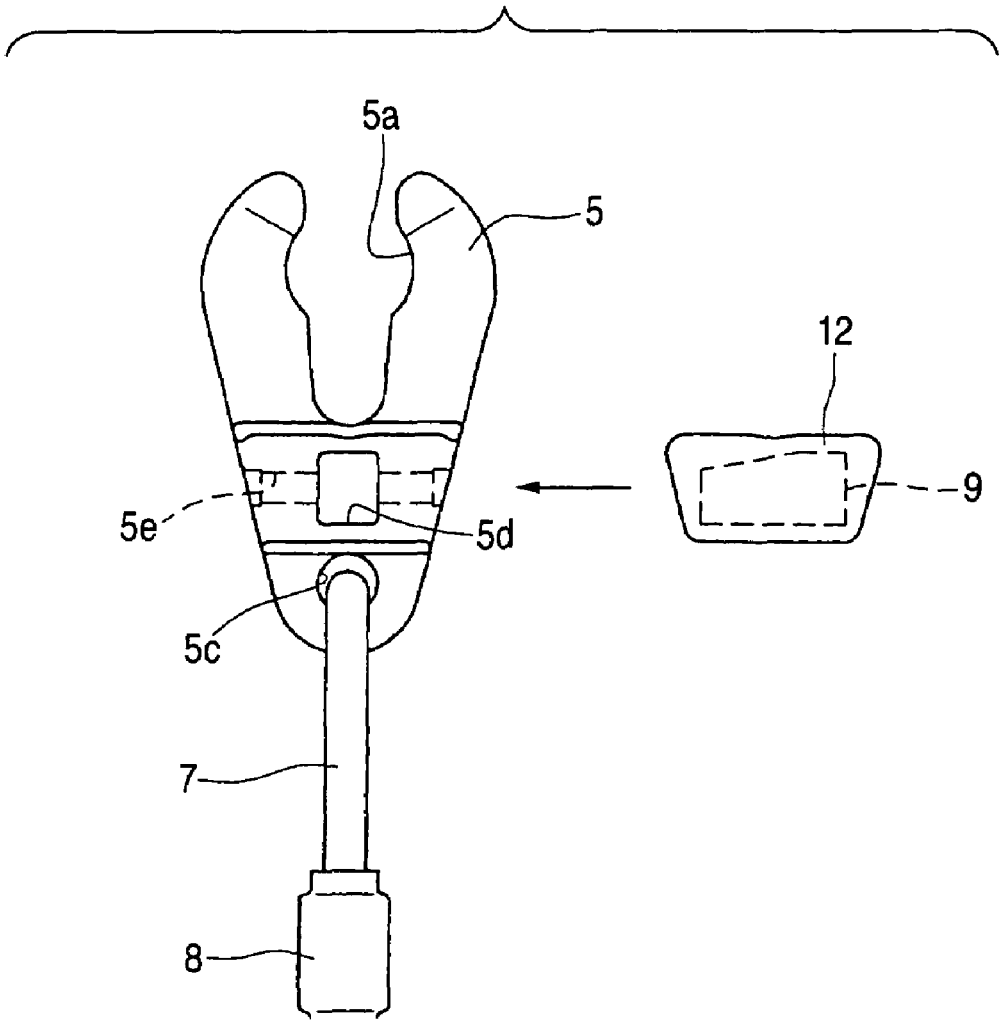
FIG. 7 is a top view illustrating the lock plate and the attachment in the engine control apparatus for the small motorboat according to embodiment 2 of the present invention.
Figure 8:
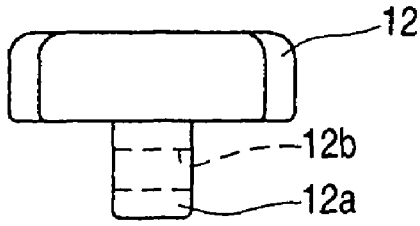
FIG. 8 is a front view illustrating the attachment in the engine control apparatus for the small motorboat according to embodiment 2 of the present invention.

As shown in FIG. 7, the lock plate 5 according to this embodiment is formed with the rectangular concave section 5*d* having a depth in the direction of the thickness, and the communicating hole 5*e* extending from the concave section 5*d* in a left and right direction so that the attachment 12 incorporating the transponder 9 can be attached thereto. Specifically, the lower face of the attachment 12 has projection 12*a* that is provided in a protruded manner and that can be engaged with the concave section 5*d*. The projection section 12*a* has lateral hole 12*b* that is communicated with the communicating hole 5*e* in a state of being engaged with the concave section 5*d*.

While the projection section 12*a* is engaged with the concave section 5*d* and the communicating hole 5*e* is communicated with the lateral hole 12*b*, the pin P (see FIG. 6) is inserted, thus allowing the attachment 13 to be attached to the lock plate 5. On the other hand, a technique for changing engine performance by the control section 11 based on the ID code from the transponder 9 is the same as that of embodiment 1.

As in embodiment 1, the transponder 9 in this embodiment is included in attachment 10 but is provided separately from the lock plate 5. As a result, even when the engine vibration is transmitted to the lock plate 5, the vibration can be absorbed between the lock plate 5 and the attachment 10 to a certain level and thus can be difficult to be transmitted to the transponder 9. This can prevent the transponder 9 from having a defect due to vibration and the service life of the transponder 9 can be improved.

Further, the control section 11 changes the engine performance based on the ID code from the transponder 9 and the transponder 9 is detachably attached to the lock plate 5. Therefore, this allows the operator to easily exchange the transponder 9 according to need. Specifically, the engine performance can be changed in accordance with the operator's preference in an easy manner.

Figure 9:
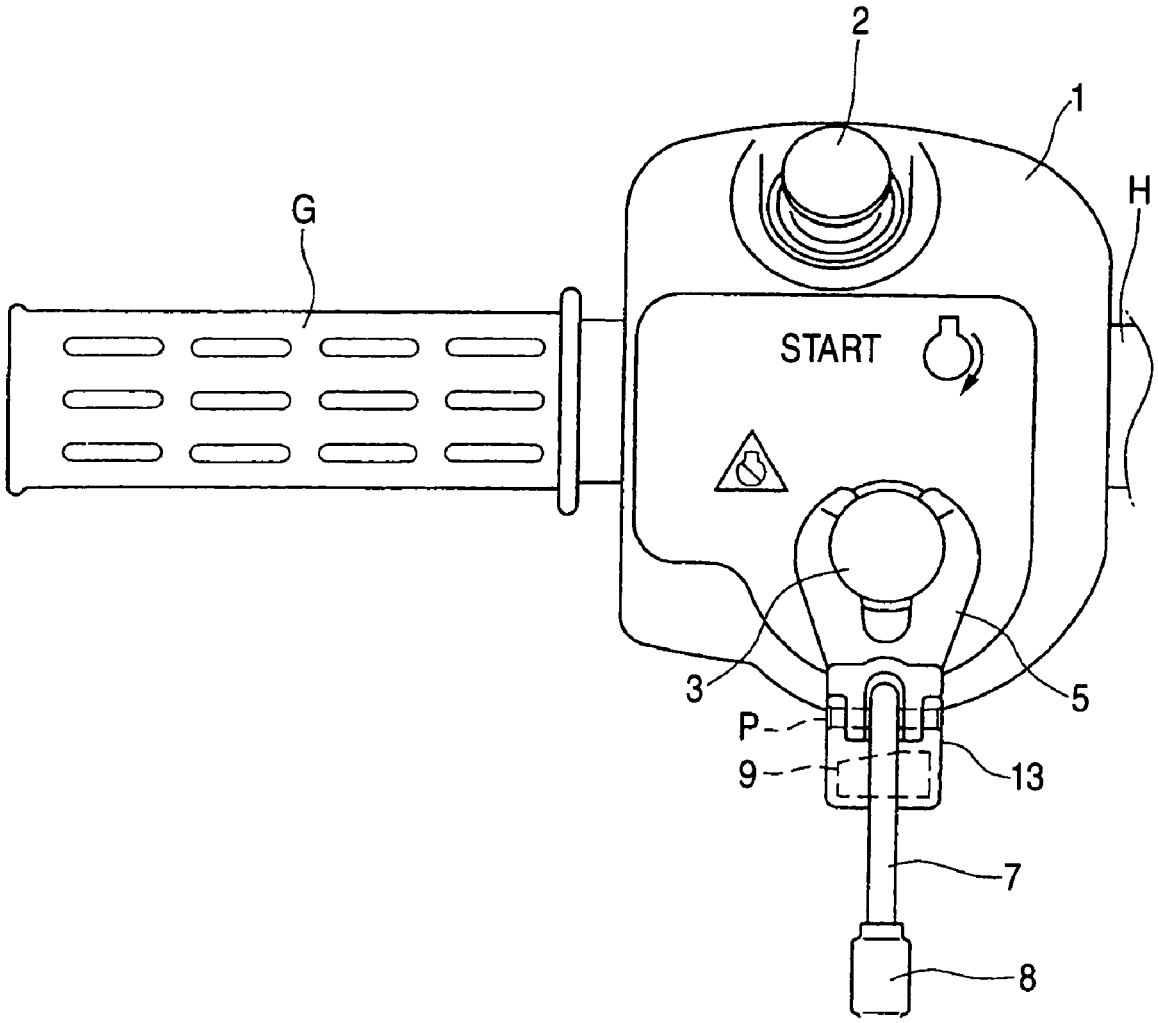
FIG. 9 is a top view illustrating the engine control apparatus for the small motorboat according to embodiment 3 of the present invention.
Figure 10:
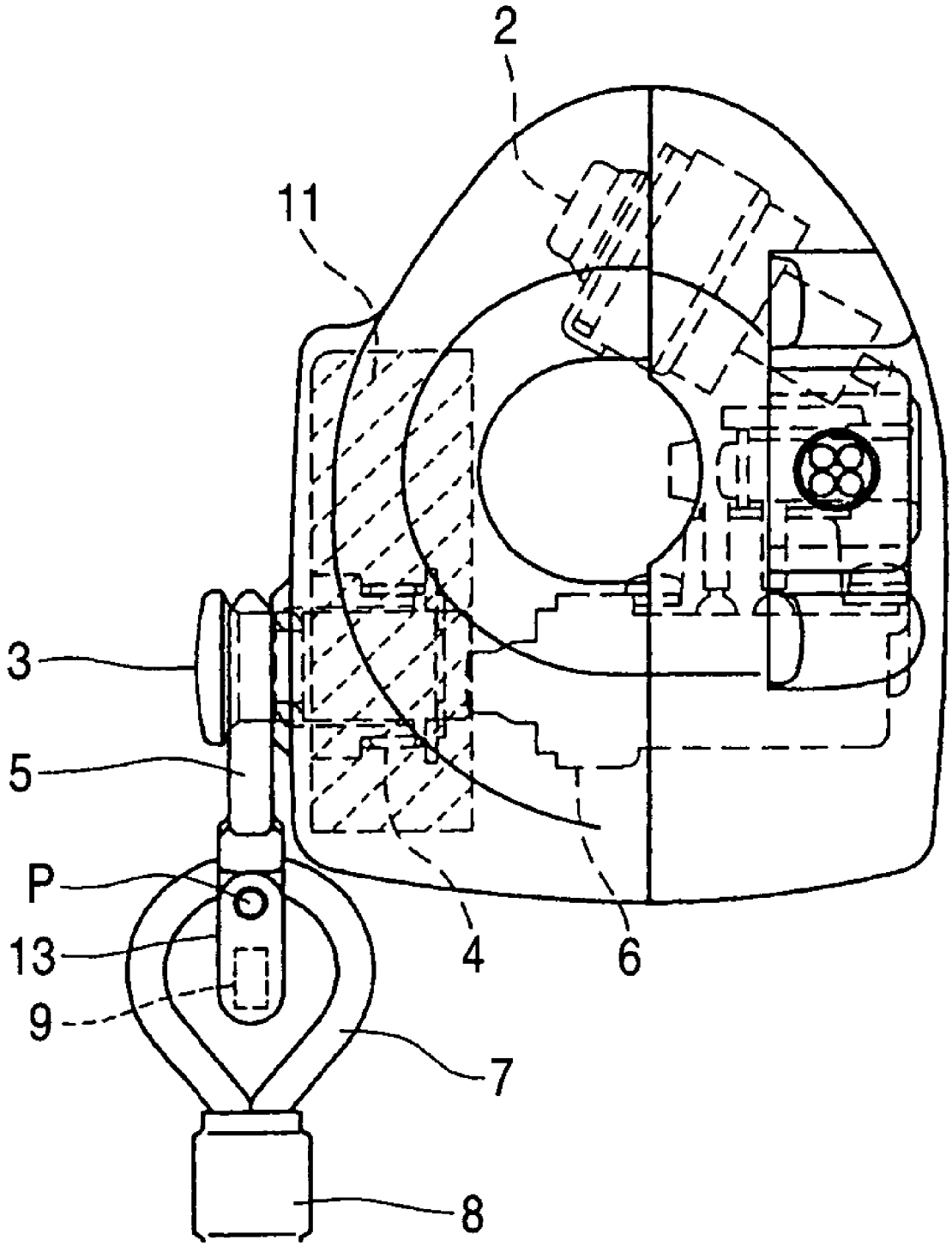
FIG. 10 is a right side view of FIG. 9.

Next, the engine control apparatus for the small motorboat according to embodiment 3 will be described. As shown in FIGS. 9 and 10, the engine control apparatus for the small motorboat according to this embodiment is formed in the resin-made switch case 1 fixed to the handle bar H of the small motorboat. The switch case 1 is provided with the start switch knob 2, the stop switch knob 3, the stop switch body 6, and the control section 11. Additionally, the same symbols are given according to the same components as those of embodiment 1 and embodiment 2, so a detailed description is omitted.

Figure 11:
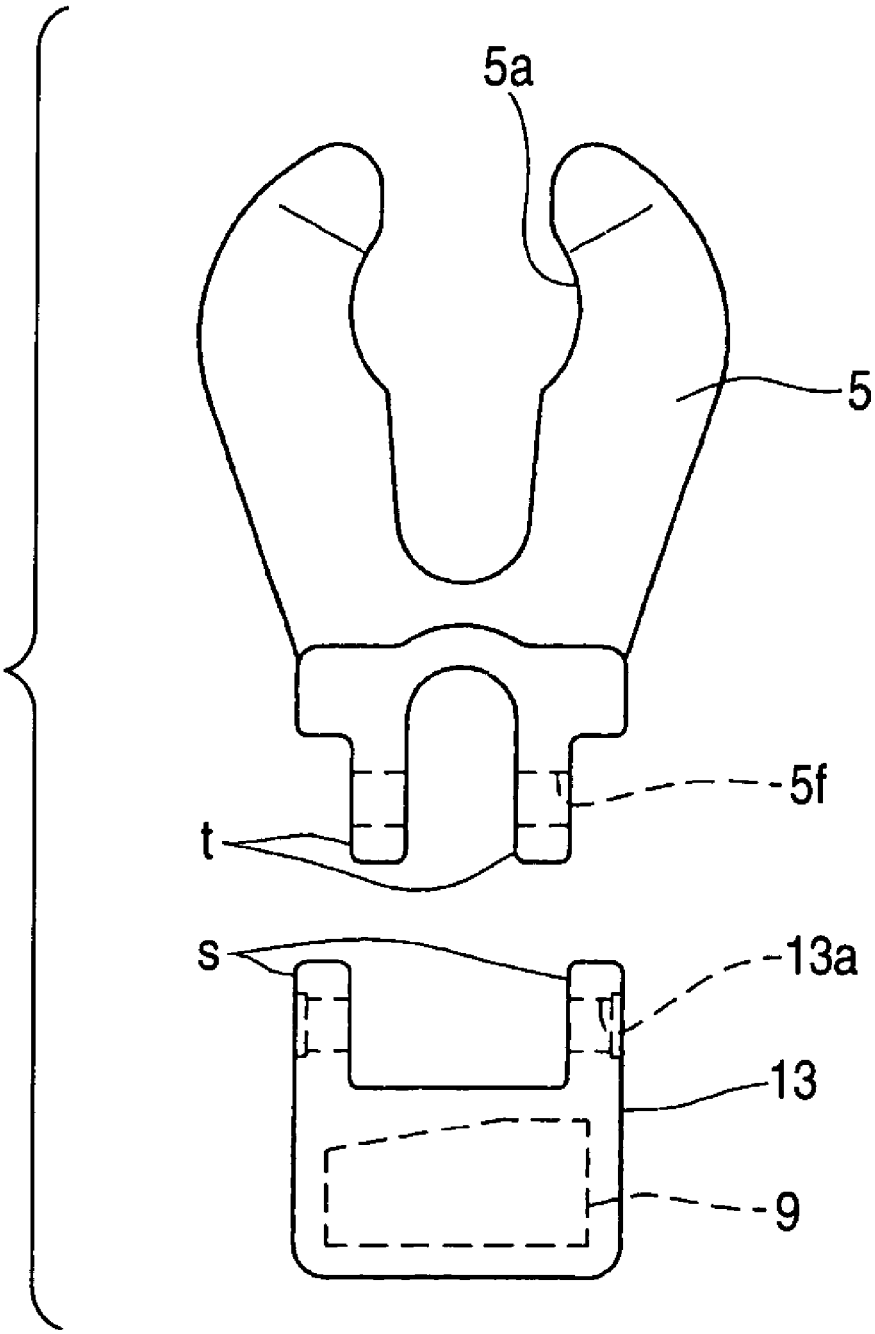
FIG. 11 is a top view illustrating the lock plate and the attachment in the engine control apparatus for the small motorboat according to embodiment 3 of the present invention.

As shown in FIG. 11, the lower end of the lock plate 5 according to this embodiment has a pair of protruded sect-ions t extending and separated by a predetermined interval. Each of the protruded sections t includes the penetrated hole 5*f*. The attachment 13 incorporating the transponder 9 also forms the protruded section s that is protruded to correspond to each protruded section t. The respective protruded sections s also form the penetrated hole 13*a*.

While the protruded section t makes or is in the vicinity of the protruded sections s and each penetrated hole 5*f* is communicated with each penetrated hole 13*a*, the pin P (see FIG. 10) is passed through these holes. As a result, the attachment 13 is attached to the lock plate 5 and the attachment 13 can be made pivotable around the pin P to the lock plate 5. It is noted that a technique for changing engine performance by the control section 11 based on the ID code from the transponder 9 is the same as that of embodiments 1 and 2.

According to this embodiment, as in embodiments 1 and 2, the transponder 9 in this embodiment is incorporated in the attachment 10 but is provided separately from the lock plate 5. As a result, even when the engine vibration is transmitted to the lock plate 5, the vibration can be absorbed between the lock plate 5 and the attachment 10 to a certain level and thus can be difficult to be transmitted to the transponder 9. This can prevent the transponder 9 from having a defect due to vibration and the service life of the transponder 9 can be improved.

The control section 11 changes the engine performance based on the ID code from the transponder 9 and the transponder 9 is detachably attached to the lock plate 5, as described above. This allows the operator to easily exchange the transponder 9 according to need. Specifically, the engine performance can be changed in accordance with the operator's preference in an easy manner.

Furthermore, the attachment 13 is can be made pivotable around the pin P to the lock plate 5. As a result, even when an excessive load is applied from the lock plate 5 side or the wire 7 side, the excessive load can be released by the pivotal movement and thus impact or the like can be difficult to be transmitted to the internal transponder 9, thus the service life of the transponder 9 can be improved.

Figure 12:
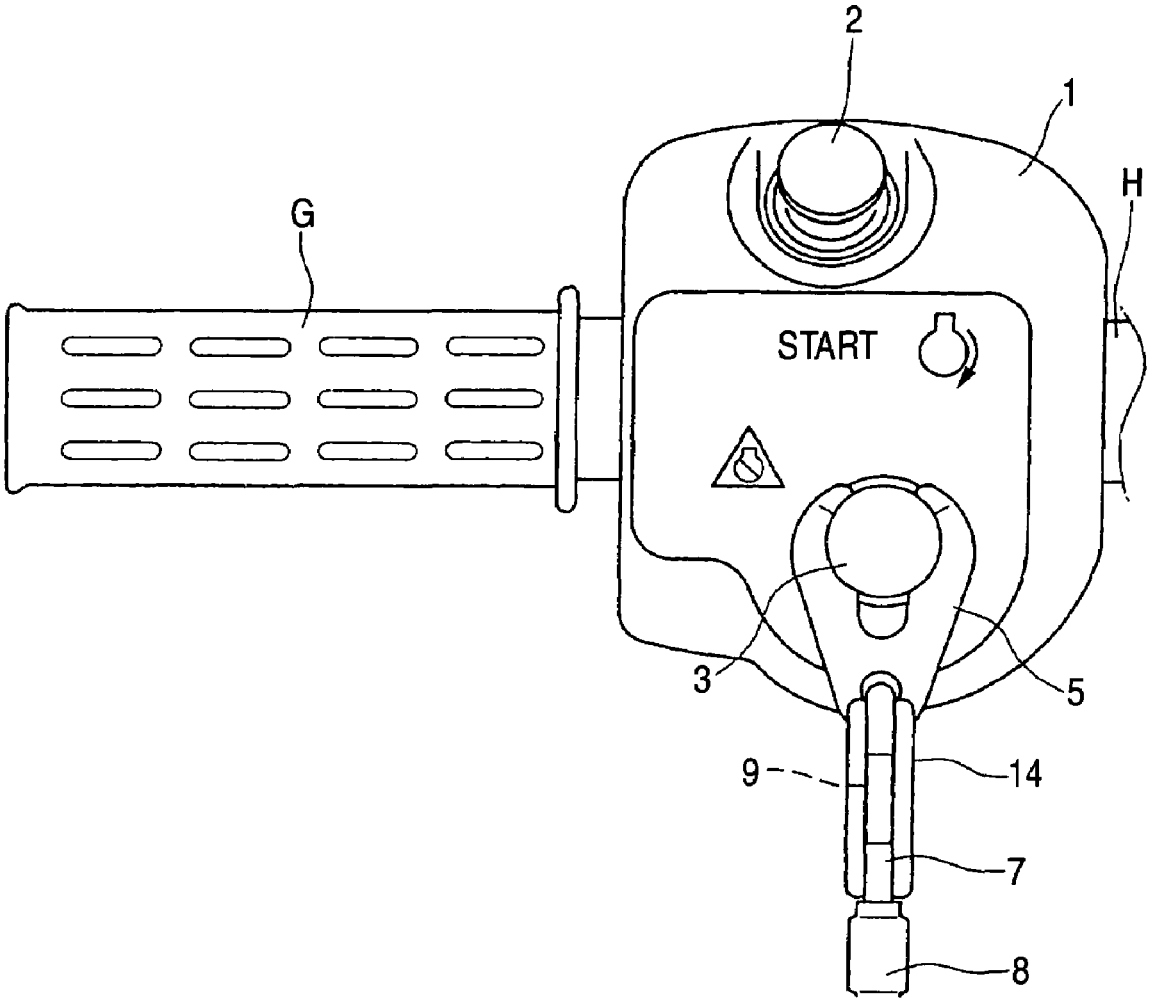
FIG. 12 is a top view illustrating the engine control apparatus for the small motorboat according to embodiment 4 of the present invention.
Figure 13:
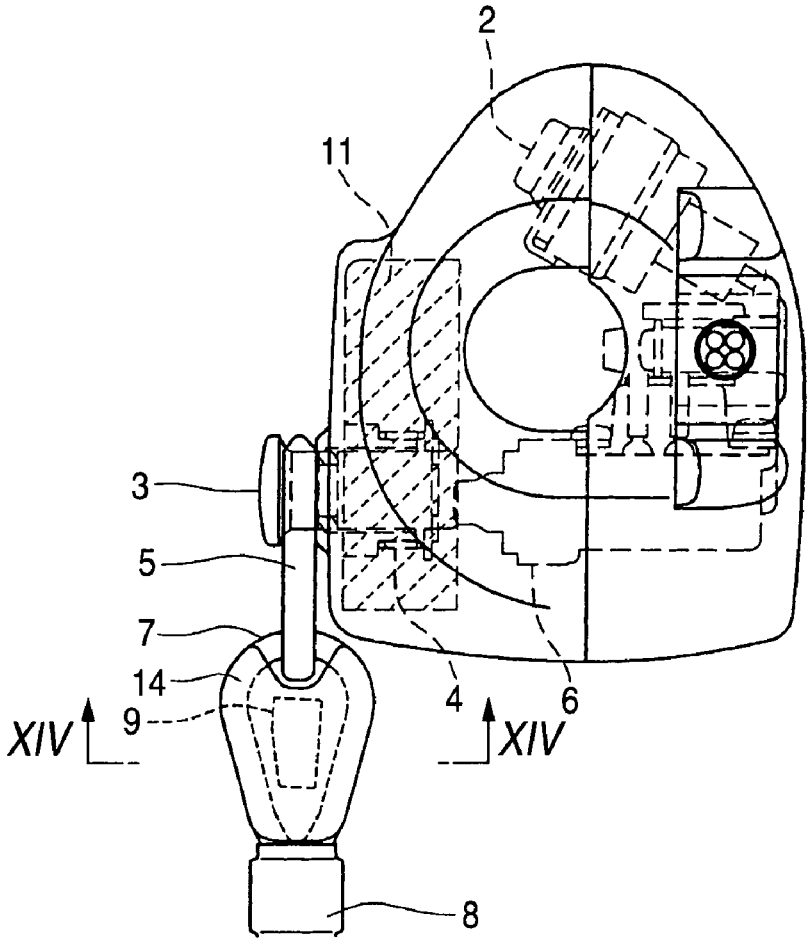
FIG. 13 is a right side view of FIG. 12.
Figure 14:
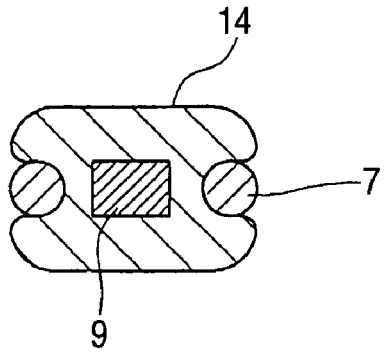
FIG. 14 is a cross-sectional view taken at the line XIV—XIV in FIG. 13.

Next, the engine control apparatus for the small motorboat according to embodiment 4 will be described. The engine control apparatus for the small motorboat according to this embodiment has the attachment 14 as shown in FIGS. 12 and 13. The attachment 14 is attached by the wire 7 connected to the lock plate 5 (a circular part formed by the part metal fitting 8). As shown in FIG. 14, the transponder 9 is inserted into the inside.

According to this embodiment, the same as in embodiments 1, 2, and 3, the transponder 9 is incorporated in the attachment 10 but is provided separately from the lock plate 5. As a result, even when the engine vibration is transmitted to the lock plate 5, the vibration can be absorbed between the lock plate 5 and the attachment 10 to a certain level and thus can be difficult to be transmitted to the transponder 9. This can prevent the transponder 9 from having a defect due to vibration and the service life of the transponder 9 can be improved.

The embodiment is described as in the above, however the present invention is not limited to this embodiment. For example, another structure may be used in which the transponder 9 is incorporated in the attachment 12 and the attachment 12 is provided separately from the lock plate 5. The attachment 12 incorporating the transponder 9 may be attached at any position in a range in which the transponder 9 and the control section 11 can communicate (i.e., in the vicinity of the lock plate 5).

Although this embodiment is applied to the small motorboat, this embodiment also may be applied to other machines (e.g., ATVs or snowmobiles). The engine performance specification is not limited to the two types of one for a beginner and one for an experienced user. The engine performance also may be set for three or more levels, including one for racing, one for experienced users (high performance), one for general user (cruise), one for beginners (course), and one for children (run), for example.

According to the invention of Aspect 1, the transponder is provided separately from the lock plate and the lock plate is provided in the vicinity of the transponder. Thus, the engine vibration transmitted to the lock plate can be absorbed. As a result, the vibration can be difficult to be transmitted to the transponder. This can prevent the transponder from having a defect and the service life of the transponder can be improved.

According to the invention of Aspect 2, the control section changes the engine performance based on the ID code from the transponder and the transponder is detachably attached to the lock plate or the vicinity thereof. This allows the operator to easily exchange the transponder according to need. Specifically, the engine performance can be changed in accordance with the operator's preference in an easy manner.

What is claimed is:

1. An engine control apparatus, comprising:

a stop switch body for allowing the engine to stop or to be in an idling state;

a stop switch knob that abuts with the stop switch body to activate the stop switch body to allow the engine to stop or to be in an idling state;

a lock plate insertable to the stop switch knob;

a transponder that is provided at the lock plate side and transmits a predetermined ID code; and a control section operable to receive the ID code transmitted from the transponder and control the engine operation based on the ID code, wherein when the lock plate is disengaged from the stop switch knob, the stop switch body is activated to allow the engine to stop or to be in an idling state, and the transponder is provided separately from the lock plate and is detachably attached to the lock plate or the vicinity thereof so the transponder is detachable without damaging the lock plate or the transponder; and wherein the control section is operable to change the engine performance based on the ID code from the transponder.

2. The engine control apparatus of claim 1, wherein the lock plate includes at least one convex section that has a groove-like shape over the surface of the lock plates and an attachment incorporating the transponder is attached to the convex section.

3. The engine control apparatus of claim 1, wherein, based on the ID code the engine performance can be changed at least between a performance corresponding to a first engine performance and a performance corresponding to a second engine performance.

4. The engine control apparatus of claim 3, wherein said transponder is a first transponder and said ID code is a first ID code corresponding to the first engine performance, and wherein the first transponder is configured to be replaced by a second transponder having a second ID code corresponding to a second engine performance.

5. The engine control apparatus of claim 3, wherein the first performance corresponds to a beginner and the second performance corresponds to an experienced user.

6. The engine control apparatus of claim 1, wherein the lock plate includes at least one concave section with a hole to which an attachment incorporating the transponder is inserted into.

7. The engine control apparatus of claim 1, wherein the lock plate includes an upper end and a lower end, the lower end having two protrusions with a hole for each that are operable to be aligned so that a pin can be inserted, the lower end incorporating the transponder.

8. The apparatus of claim 3, wherein the attachment is operable to absorb vibrations from the engine.

9. The apparatus of claim 6, wherein the attachment is operable to absorb vibrations from the engine.

10. The apparatus of claim 7, wherein the attachment is operable to absorb vibrations from the engine.

11. The engine control apparatus of claim 4, wherein the first transponder and the second transponder are configured to be readily interchanged by different operators of the engine so as to change the performance of the engine.

12. The engine control apparatus of claim 4, wherein the first transponder and the second transponder are configured to be exchanged by selectively unclipping one of the first and second transponders that is already clipped to the lock plate and clipping in its place the other of the first and second transponders to the lock plate.

13. The engine control apparatus of claim 4, wherein the first transponder and the second transponders are configured to be selectively clipped to the lock plate by an operator of the engine without tools.

14. The engine control apparatus of claim 4, wherein each of the first transponders and the second transponders comprises a section that sandwiches a portion of the lock plate so as to clip to the lock plate.

* * * * *